US011388508B2

(12) United States Patent
Bullimore et al.

(10) Patent No.: US 11,388,508 B2
(45) Date of Patent: Jul. 12, 2022

(54) COAXIAL LOUDSPEAKER

(71) Applicant: Tymphany Acoustic Technology Limited, Taipei (TW)

(72) Inventors: George Albert Bullimore, Taipei (TW); Gavin Jones, Taipei (TW); Stuart Martin Hancock, Taipei (TW)

(73) Assignee: TYMPHANY ACOUSTIC TECHNOLOGY LIMITED, Taipei (TW)

( * ) Notice: Subject to any disclaimer, the term of this patent is extended or adjusted under 35 U.S.C. 154(b) by 0 days.

(21) Appl. No.: 16/992,797

(22) Filed: Aug. 13, 2020

(65) Prior Publication Data

US 2021/0058698 A1 Feb. 25, 2021

Related U.S. Application Data

(60) Provisional application No. 62/890,892, filed on Aug. 23, 2019.

(51) Int. Cl.

| | |
|---|---|
| ***H04R 1/24*** | (2006.01) |
| ***H04R 1/28*** | (2006.01) |
| ***H04R 7/12*** | (2006.01) |

(52) U.S. Cl.
CPC ..... *H04R 1/24* (2013.01); *H04R 1/2811* (2013.01); *H04R 7/12* (2013.01)

(58) Field of Classification Search
CPC ..... H04R 1/24; H04R 1/2811; H04R 7/11
See application file for complete search history.

(56) References Cited

U.S. PATENT DOCUMENTS

| | | | | |
|---|---|---|---|---|
| 4,619,342 | A * | 10/1986 | Buck | H04R 9/063 181/144 |
| 2009/0310808 | A1* | 12/2009 | Button | H04R 1/24 381/339 |
| 2020/0177988 | A1* | 6/2020 | Zastoupil | H04R 1/323 |

* cited by examiner

*Primary Examiner* — Andrew L Sniezek
(74) *Attorney, Agent, or Firm* — Muncy, Geissler, Olds & Lowe, P.C.

(57) ABSTRACT

A coaxial loudspeaker includes a cone of a woofer; a waveguide of a tweeter, located at a front end towards the outside/large profile of the cone; and a first cavity. The first cavity includes a resonator and a cavity formed in the cone, and the resonator communicates with the cavity at the large profile of the cone. A side opposite to a position where the resonator communicates with the cavity is constructed as an orifice plate. The orifice plate is adjacent to the resonator and an orifice portion of the orifice plate communicates with the resonator.

13 Claims, 2 Drawing Sheets

COAXIAL LOUDSPEAKER

CROSS REFERENCE TO RELATED APPLICATIONS

The present application claims priority under 35 U.S.C. 119 to U.S. Provisional Application No. 62/890,892, which was filed on Aug. 23, 2019, the entire contents of which are hereby incorporated by reference.

TECHNICAL FIELD

The application relates to the technical field of loudspeakers, and in particular to a coaxial loudspeaker.

BACKGROUND

The existing coaxial loudspeaker refers to two loudspeakers mounted on the same axial center, namely the tweeter and the woofer that respectively play the high frequencies and the mid-low frequencies. The acoustic low-pass filter is often used in the woofer/transducer of the coaxial loudspeaker.

However, the existing coaxial loudspeaker is not satisfactory in every aspect, for example, the improvements are made necessarily in low-pass filter performance of the woofer. Additionally, the common coaxial loudspeaker is susceptible to high-frequency diffraction at the edge of the tweeter.

SUMMARY OF THE APPLICATION

In view of the problem in the relevant art, the application provides a coaxial loudspeaker, which can at least implement the desired low-pass effect without additional electrical components and can improve the response of the tweeter.

The technical solution of the present application is implemented as follows.

According to an aspect of the present application, a coaxial loudspeaker is including a cone of a woofer, a waveguide of a tweeter, located at a front end towards an outside/large profile end of the cone and a first cavity. The first cavity includes a resonator and a cavity formed in the cone, and the resonator communicated with the cavity at the large profile of the cone. A side opposite to a position where the resonator is communicated with the cavity is constructed as an orifice plate, the orifice plate is adjacent to the resonator and an orifice portion of the orifice plate is communicated with the resonator.

According to an embodiment of the present application, the resonator is located at the front end towards the outside/large profile of the cone.

According to an embodiment of the present application, the resonator is a Helmholtz resonator, and is arranged coaxially with the cone.

According to an embodiment of the present application, the orifice plate is separated from the waveguide of the tweeter.

According to an embodiment of the present application, the coaxial loudspeaker includes a first outer wall surrounding the waveguide and arranged at the periphery of an outer side of the large profile, the first outer wall connected to the large profile and the first outer wall connected to a second outer wall via the orifice plate. The second outer wall is located on a peripheral wall surface of the waveguide. The resonator is located between the first outer wall and the second outer wall. An inner wall of the cone is opposite to the second outer wall to form a channel for communicating.

According to an embodiment of the present application, an end of the large profile of the cone, and the first outer wall are connected together via a suspension.

According to an embodiment of the present application, the suspension comprises a surround that is bent and extended from the large profile of the cone to connect to the first outer wall, and the surround may be protruded towards or away from an inner direction of the resonator.

According to an embodiment of the present application, the orifice plate and the second outer wall are integrally formed.

According to an embodiment of the present application, the coaxial loudspeaker includes a low-pass filter used for the woofer, the low-pass filter comprising an inductor having a plurality of coil windings.

According to an embodiment of the present application, the orifice portion on the orifice plate includes a plurality of holes arranged at intervals around the waveguide.

In the application, by providing the ported cavity on the front end of the acoustic propagation path of the woofer, the resonance can be obtained on the upper region of the frequency response of the loudspeaker, and thus the ported cavity may serve as the acoustic low-pass filter with a peak at the resonant frequency. Therefore, the desired low-pass effect is implemented without any additional electrical component.

BRIEF DESCRIPTION OF THE ACCOMPANYING DRAWINGS

In order to illustrate the technical solutions in the embodiments of the present application in the prior art more clearly, the drawings which are required to be used in the description of the embodiments of the present application are briefly described below. It is obvious that the drawings described below are only some embodiments of the present disclosure. It is apparent to those skilled in the art that other drawings may be obtained based on the accompanying drawings without giving inventive effort.

DETAILED DESCRIPTION OF THE PREFERRED EMBODIMENTS

The technical solutions of the embodiments of the present application will be clearly and completely described in the following with reference to the accompanying drawings. It is obvious that the embodiments to be described are only a part the embodiments of the present application rather than all of the embodiments of the present application. All other embodiments obtained by those skilled in the art based on the embodiments of the present application are within the protection scope of the present application.

Figure 1:
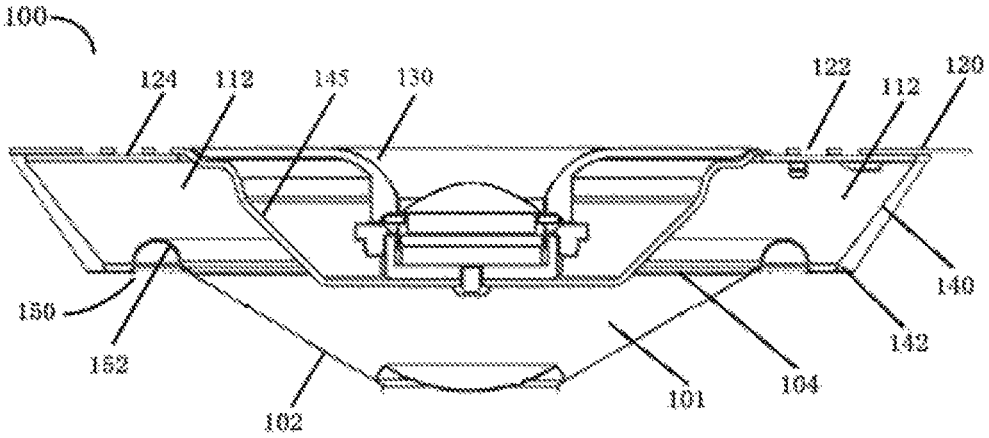
FIG. 1 illustrates a sectional view of a coaxial loudspeaker according to an embodiment of the application.

As shown in FIG. 1, a coaxial loudspeaker 100 is provided according to an embodiment of the application. The coaxial loudspeaker 100 includes a woofer and a waveguide 130 of a tweeter. The woofer is provided with a cone 102. The waveguide 130 is located at a front end towards an outside/large profile 104 of the cone 102. The coaxial loudspeaker 100 further includes a first cavity including a resonator 112 formed on an outer side of the waveguide 130 of the tweeter and a cavity 101 formed in the cone 102. The resonator 112 communicates with the cavity 101 at the large profile of the cone 102. One side of the first cavity is constructed as an orifice plate 120, and an orifice portion 122 of the orifice plate 120 communicates with the resonator 112. The orifice plate 120 is located on an outward side of an acoustic propagation path of the coaxial loudspeaker 100, and the orifice plate 120 is adjacent to the resonator 112 and opposite to a position where the cavity 101 is formed in the cone 102.

According to the coaxial loudspeaker provided by the application, the woofer radiates the voice in the ported cavity; and by providing the ported cavity on the front end of the acoustic propagation path of the woofer, the resonance can be obtained on the upper region of the frequency response of the loudspeaker and, thus, the ported cavity may serve as the acoustic low-pass filter with a peak at the resonant frequency. Therefore, the desired low-pass effect is implemented without any additional electrical component. Additionally, the ported cavity is provided and such a structure is transparent to the low frequency and obstructive to the high frequency, so no interference is caused for the woofer, and the structure may serve as a surface for obstructing the high frequency generated by the tweeter. Therefore, the response of the tweeter is not susceptible to the baffle step effect, and may implement the smoothness property. In an embodiment, the overall sensitivity of the tweeter may be improved.

It should be understood that any appropriate configuration may be made on the structure of the resonator 112 and the structure of the orifice portion 122 on the orifice plate 120 according to the desired resonance frequency and low-pass effect of the ported resonator 112, which is not defined by the application thereto.

In an embodiment, the resonator 112 may be referred to as a Helmholtz resonator. In an embodiment, the resonator 112 and the cone 102 are coaxially arranged. It may be appropriate to design the structures of the resonator 112 and the orifice portion 122 to obtain the Helmholtz resonance on the upper region of the frequency response.

Referring also to FIG. 1, in an embodiment, the resonator 112 is located at the end towards the outside/large profile 104 of the cone 102. The orifice plate 120 and the cavity 101 are located on two opposite sides of the resonator 112. It should be understood that the front end refers to the front end of the acoustic propagation path of the woofer.

In an embodiment, the coaxial loudspeaker 100 may further include a screen 124 located on a surface of a side of the orifice plate 120 towards the resonator 112, and the screen 124 covers the orifice portion 122 of the orifice plate 120. The screen 124 may be transparent to low frequency and obstructive to high frequency. As a consequence, the frequency response of the woofer is not modified, and the overall frequency response of the woofer is relatively smooth.

Figure 2:
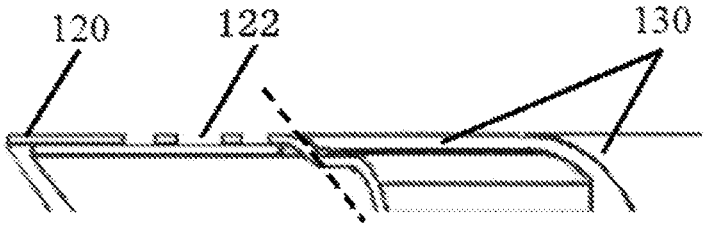
FIG. 2 illustrates a partially enlarged schematic diagram in FIG. 1.

As shown in FIG. 2, the orifice plate 120 is separated from the waveguide 130 of the tweeter, which is illustrated by the dotted line in FIG. 2. More specifically, the orifice portion 122 of the orifice plate 120 is separated from the waveguide 130 of the tweeter. In this way, the Helmholtz resonators of the tweeter and the woofer are not coupled, such that neither the resonance nor the diffraction phenomenon is caused, and the frequency response is smoother.

According to an embodiment of the application, the coaxial loudspeaker 100 may further include another low-pass filter for the woofer, the low-pass filter including an inductor having a plurality of coil windings. In an embodiment, the inductor is provided with four coil windings. The inductor of the woofer may have a relatively high inductance, and may serve as a smooth low-pass filter. In an embodiment, the maximum effect of the low-pass filter formed by the inductor is 6 dB/octave. In an embodiment, the low-pass filter may serve as a second-order low-pass filter. Therefore, in combination with the ported resonator 112 and the low-pass filter formed by the inductor, the low-pass filter effect having 24 dB/octave may be obtained.

In an embodiment, the coaxial loudspeaker 100 further includes a first outer wall 140 and a second outer wall 145. The first outer wall 140 is disposed at the periphery of the large profile 104 in a manner of surrounding the waveguide 130. Furthermore, the first outer wall 140 is connected to the large profile 104 of the cone 102, and the second outer wall 145 is located on a peripheral wall surface of the waveguide 130. Additionally, the first outer wall 140 is further connected to the second outer wall 145 together via the orifice plate 120. As shown in FIG. 1, an inner wall of the cone 102 is opposite to the second outer wall 145 to form a channel for communicating. The resonator 112 is located between the first outer wall 140 and the second outer wall 145, and the orifice portion 122 on the orifice plate 120 is an acoustic outlet of the woofer.

In addition, the outer wall 140 is provided with an end 142 distal from the orifice plate 120, and the end 142 of the outer wall 140 may be connected to the large profile 104 of the cone 102 together via a suspension 150. In such a manner, the resonator 112 may be provided with a portion located out of a region enclosed by the suspension 150. In an embodiment, the suspension 150 may be constructed as a surround 152 that is bent and extended from the large profile 104 of the cone 102 to an outer side of the cone 102, so as to connect to the end of the first outer wall 140 and a bent portion of the surround 152 may be raised towards or away from an inner side of the resonator 112. In an embodiment, the orifice plate 120 and the second outer wall 145 may be an integral part.

Figure 3:
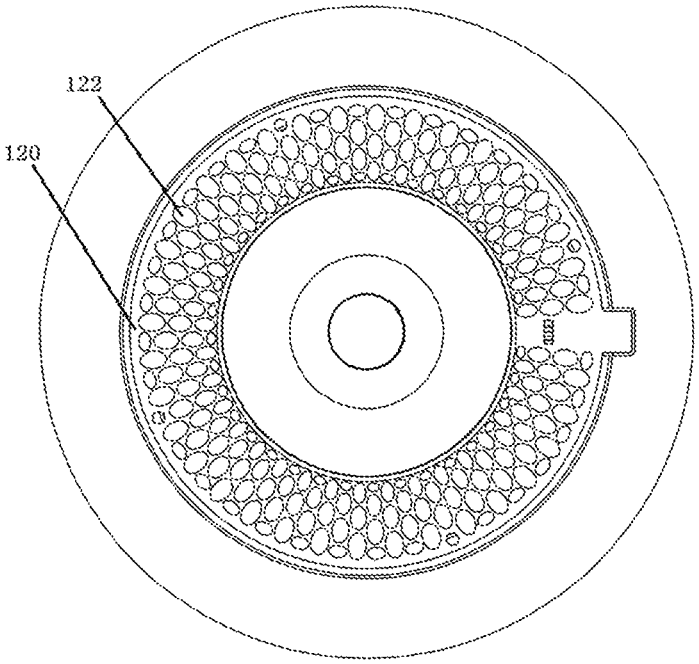
FIG. 3 illustrates a top view of a coaxial loudspeaker according to an embodiment of the application.

As shown in FIG. 1 and FIG. 3, in an embodiment, the orifice portion 122 of the orifice plate 120 is constructed as a plurality of spaced holes arranged around the waveguide 130. It should be understood that the orifice portion 122 of the orifice plate 120 shown in FIG. 3 is merely illustrative, and any appropriate configuration may be made on the orifice portion 122 of the orifice plate 120 according to the desired low-pass effect of the ported resonator 112, which is not defined by the application thereto. The number of the plurality of spaced holes 122 of the orifice plate 120 may be any appropriate value. The shape of the holes 122 of the orifice plate 120 may be any appropriate shape. The holes 122 of the orifice plate 120 may be arranged in any appropriate arrangement manner.

The foregoing is only preferred embodiments of the present application and is not intended to limit the present application, and any modifications, equivalent substitutions, improvements and the like within the spirit and principles of the present application are intended to be embraced by the protection scope of the present application.

The invention claimed is:

1. A coaxial loudspeaker, comprising:

a cone of a woofer;

a waveguide of a tweeter, the waveguide being located at a front end of the cone towards an outer profile of the cone; and a first cavity, the first cavity comprising:

a resonator and a woofer cavity formed in the cone of the woofer, the resonator communicating with the woofer cavity at the outer profile of the cone, wherein a side opposite to a position where the resonator communicates with the woofer cavity is constructed as an orifice plate, the orifice plate is adjacent to the resonator and an orifice portion of the orifice plate communicates with the resonator, and wherein the orifice plate is spaced apart from the waveguide of the tweeter by at least a portion of an outer wall of the coaxial loudspeaker that extends between the waveguide of the tweeter and the orifice plate.

2. The coaxial loudspeaker according to claim 1, wherein the resonator is located at the front end towards the outer profile of the cone.

3. The coaxial loudspeaker according to any one of claim 1, wherein the resonator is a Helmholtz resonator and is arranged coaxially with the cone.

4. The coaxial loudspeaker according to claim 1 wherein the orifice portion on the orifice plate includes a plurality of holes arranged at intervals around the waveguide.

5. A coaxial loudspeaker, comprising:

a cone of a woofer;

a waveguide of a tweeter, the waveguide being located at a front end of the cone towards an outer profile of the cone;

a first cavity, the first cavity comprising:

a resonator and a cavity formed in the cone, the resonator communicating with the cavity at the outer profile of the cone, wherein a side opposite to a position where the resonator communicates with the cavity is constructed as an orifice plate, the orifice plate is adjacent to the resonator and an orifice portion of the orifice plate communicates with the resonator; and a first outer wall surrounding the waveguide and arranged at a periphery of an outer side of the outer profile, the first outer wall being connected to the outer profile and the first outer wall connected to a second outer wall via the orifice, wherein the second outer wall is located on a peripheral wall surface of the waveguide, wherein the resonator is located between the first outer wall and the second outer wall, and wherein an inner wall of the cone is opposite to the second outer wall to form a channel for communicating.

6. The coaxial loudspeaker according to claim 5, further comprising a suspension connecting the outer profile of the cone and the first outer wall.

7. The coaxial loudspeaker according to claim 6, wherein the suspension comprises a surround that is bent and extended from the profile of the cone to connect to the first outer wall, and the surround is protruded towards or away from an inner direction of the resonator.

8. The coaxial loudspeaker according to claim 5, wherein the orifice plate and the second outer wall are integrally formed.

9. A coaxial loudspeaker, comprising:

a woofer including a cone;

a tweeter including a waveguide;

a first outer wall connected to the cone of the woofer;

a second outer wall extending within a region located between the first outer wall and the waveguide of the tweeter; and an orifice plate connecting the first outer wall and the second outer wall;

wherein a resonator is formed between the first outer wall and the second outer wall, wherein the resonator is bounded by the orifice plate, and wherein the second outer wall separates the resonator from the waveguide of the tweeter.

10. The coaxial loudspeaker according to claim 9, wherein the tweeter is coaxially arranged with the woofer.

11. The coaxial loudspeaker according to claim 9, wherein at least a portion of the second outer wall separates the orifice plate from the waveguide of the tweeter.

12. The coaxial loudspeaker according to claim 9, wherein the first outer wall is connected to the cone of the woofer via a suspension structure.

13. The coaxial loudspeaker according to claim 9, wherein the resonator is a Helmholtz resonator.

* * * * *